US007213422B2

(12) United States Patent
Miyamoto

(10) Patent No.: US 7,213,422 B2
(45) Date of Patent: May 8, 2007

(54) NEEDLE SELECTION DEVICE FOR WEFT KNITTING MACHINE

(75) Inventor: Masaki Miyamoto, Wakayama (JP)

(73) Assignee: Shima Seiki Manufacturing Limited, Wakayama-shi (JP)

( * ) Notice: Subject to any disclaimer, the term of this patent is extended or adjusted under 35 U.S.C. 154(b) by 0 days.

(21) Appl. No.: 10/519,209

(22) PCT Filed: Jun. 4, 2003

(86) PCT No.: PCT/JP03/07059

§ 371 (c)(1),
(2), (4) Date: Feb. 2, 2006

(87) PCT Pub. No.: WO2004/003275

PCT Pub. Date: Jan. 8, 2004

(65) Prior Publication Data

US 2006/0201208 A1 Sep. 14, 2006

(30) Foreign Application Priority Data

Jun. 26, 2002 (JP) ..... 2002-186284

(51) Int. Cl.
*D04B 9/00* (2006.01)

(52) U.S. Cl. ..... 66/216

(58) Field of Classification Search ..... 66/216, 66/222, 64, 75.1, 75.2
See application file for complete search history.

(56) References Cited

U.S. PATENT DOCUMENTS 4,490,994 A * 1/1985 Essig ..... 66/75.1
5,134,865 A 8/1992 Shima et al.
5,251,462 A * 10/1993 Shima ..... 66/78
5,343,719 A * 9/1994 Nakamori et al. ..... 66/75.1
5,694,792 A 12/1997 Nakamori et al.
5,802,878 A 9/1998 Nakamori et al.
5,819,559 A 10/1998 Nakamori et al.
6,568,222 B1 5/2003 Morita
6,584,810 B2 * 7/2003 Nakahata et al. ..... 66/75.2

FOREIGN PATENT DOCUMENTS

JP 5-83657 B2 11/1993
JP 6-200454 A 7/1994
JP 6-220752 A 8/1994
JP 9-241952 A 9/1997
WO WO 01/36730 A1 5/2001

* cited by examiner

*Primary Examiner*—Danny Worrell
(74) *Attorney, Agent, or Firm*—Harness, Dickey & Pierce, P.L.C.

(57) ABSTRACT

A needle selecting apparatus for a weft knitting machine capable of performing a needle selecting position locking function without moving a selecting jack forward and backward is provided. In the needle selecting apparatus, an initial position of the selecting jack is set at a welt position to ready for non-operation. And when a butt is pressed by a B presser of a carriage, the selecting jack comes into a locked condition by a locking member. The selecting jack is sunk into a needle groove in the locked condition and the butt of a knitting needle is also sunk into the needle groove to separate from a knitting cam. When a knitting position or tucking position is selected by a needle selection actuator, a selector is driven by a selector cam, and a tip of the selecting jack presses a contact portion of the selecting jack to move the selecting jack rightward. During the movement, the locking member is drawn to release the locked condition.

6 Claims, 12 Drawing Sheets

(a)

(b)

NEEDLE SELECTION DEVICE FOR WEFT KNITTING MACHINE

TECHNICAL FIELD

The present invention relates to a needle selecting apparatus for a weft knitting machine capable of selecting appropriate knitting needles provided in the weft knitting machine in correspondence with various types of knitting operations.

BACKGROUND ART

In a conventional weft knitting machine, various modified knitting organizations are produced by combining three basic positions of knitting, tucking and welting (missing) in knitting operations by means of knitting needles. In a structure of a typical weft knitting machine, a carriage reciprocates along a needle bed having a plurality of needle grooves in a longitudinal direction, and each knitting needle performs knitting operation through a cam mechanism included in the carriage. The carriage is accompanied with a yarn supply member for supplying a knitting yarn to the knitting needles which perform knitting operation, and the plural knitting needles sequentially carry out the knitting operation in correspondence with the yarn supply position of the yarn supply member. The cam mechanism is basically formed to correspond to the knitting operation in the knitting position, and a needle selecting apparatus for selecting the knitting needles for the tucking or welting position is provided in each needle groove.

The applicant of the invention previously proposed needle selecting apparatus in Japanese Unexamined Patent Publications JP-A 6-200454, JP-A 6-220752, JP-A 9-241952 and other publications. FIG. 13 schematically shows a structure of a needle selecting mechanism disclosed in JP-A 9-241952, which is partially modified for the sake of descriptive convenience. A weft knitting machine 1 has a carriage 3 which reciprocates along a needle bed 2 extending in a longitudinal direction. Grooves to which needle plates 4 are fitted in predetermined intervals are formed on the needle bed 2 in the longitudinal direction. Needle grooves 5 are provided between the needle plates 4, and knitting needles 6 are disposed in the needle grooves 5 where the knitting needles 6 can be slidingly displaced. The weft knitting machine 1 includes at least a pair of the front and rear needle beds 2 whose front faces extend in parallel with the longitudinal direction, and the needle beds 2 are opposed to each other with a needle bed gap 7 interposed therebetween. However, only a side cross section of one of the needle beds 2 is shown in this figure and the other is omitted for the sake of descriptive convenience. Also, the sliding displacement direction of the knitting needle 6 is inclined upward toward the needle bed gap 7, but the inclination of the needle bed 2 is omitted and such a posture that the knitting needle 6 is slidingly displaced in a horizontal direction is shown. The carriage 3 is attached to the front and rear needle beds 2 in such a manner as to cross over the needle bed gap 7, and is accompanied with a yarn supply member for supplying a knitting yarn along the needle bed gap 7.

The knitting needle 6 has a needle main body 8 as the front haft and a needle jack 9 as the rear half when the needle bed gap 7 is the front and the opposite side is the rear in each needle groove 5 as viewed from the side of the weft knitting machine 1. A hook and other components for receiving a knitting yarn used for knitting operation are provided at the front end of the needle main body 8. The needle jack 9 has a driving butt 9*a* for advancing and retracting the knitting needle 6 within the needle groove 5. The needle jack 9 disposed in the needle groove 5 has a bent shape such that the butt 9*a* can project toward the carriage 3 by elasticity. When the butt 9*a* projects toward the carriage 3, a knitting cam 10 provided on the carriage 3 acts on the knitting needle 6, whereby the needle 6 can advance and retract in the needle groove 5 with respect to the needle bed gap 7.

A needle selecting apparatus 11 is provided for each knitting needle 6 for controlling the action of the knitting cam 10 given to the knitting needle 6. The needle selecting apparatus 11 includes a selecting jack 12 and a selector 13. The selecting jack 12 is disposed in the rear region of the needle jack 9 near the carriage 3, and a butt 12*a* projects toward the carriage 3. The position of the selecting jack 12 is determined by the selector 13 such that the butt 12*a* is positioned in any of B position, H position and A position. The selector 13 has butts 13*a*, 13*b* and 13*c* which project toward the carriage 3, and is shifted within the needle groove 5 by the action of a selector cam 14 provided on the carriage 3. When the selector 13 shifts to the front, a tip 13*d* pushes and advances the selecting jack 12. The advanced position of the selecting jack 12 is determined by action of a needle selection actuator 15 which is disposed near the carriage 3 in such a position that the rear half of the selector 13 is sandwiched between the needle selection actuator 15 and the selector cam 14.

The selector 13 disposed in the needle groove 5 has a bent shape such that an armature 13*e* formed in a position facing the needle selection actuator 15 in the rear half region can be separated from the needle selection actuator 15 by elasticity. When the selector cam 14 pushes the butt 13*c* disposed in the rear region, the armature 13*e* contacts the needle selection actuator 15 and is magnetically attracted thereto. The needle selection actuator 15 has two release positions, for example, where the attraction is released to conduct needle selection by energization for each knitting needle 6. The selector cam 14 has cam grooves in positions corresponding to the respective release positions so as to advance the selector 13 when the attraction for the armature 13*e* of the selector 13 is released and the butt 13*b* projects toward the carriage 3. When the attraction for the armature 13*e* is released in the release position disposed ahead of the traveling carriage 3, the selector 13 advances to a position corresponding to the knitting operation (A position). When the attraction is released in the release position disposed behind the traveling carriage 3, the selector 13 advances to a position corresponding to the tucking operation (H position). When the attraction is not released in either position, a position corresponding to the welting operation (B position) is maintained.

The selecting jack 12 is pushed by the tip 13*d* of the selector 13 and thereby advances within the needle groove 5. The butt 12*a* of the selecting jack 12 at each position is pressed by a B presser 16 and an H presser 17 provided on the carriage 3. By pushing down the butt 12*a* and sinking the selecting jack 12 into the needle groove 5, the needle jack 9 is also pushed down into the needle groove 5 whereby the butt 9*a* is separated from the knitting cam 10. The B presser 16 is provided to correspond to the welting position (B position) as a non-operative position of the knitting operation, and separate the butt 9*a* from the knitting cam 10 for almost the entire stroke. The H presser 17 is provided to correspond to the tucking position (H position). In this position, the knitting cam 10 acts on the butt 9*a* until the needle main body 8 advances part of the way toward the needle bed gap 7, and subsequently the H presser 17 pushes down the butt 12*a* to separate the butt 9*a* from the knitting cam 10. In the knitting position (A position), no presser is provided and the knitting cam 10 acts on the knitting needle 6 for the entire stroke.

Wires 18 and 19 penetrate the needle groove 5 in the longitudinal direction of the needle bed 2 to restrict the range of sliding displacement of the selecting jack 12 in the needle groove 5. Concaves 12*b*, 12*c* and 12*d* disposed inside a forked portion into which the rear wire 19 is inserted engage with the wire 19 to maintain the respective positions of the selecting jack 12. A guide cam which acts on the butt 12*a* is provided on the selector cam 14 so that the selecting jack 12 can retract to an initial position as the welting position after the knitting operation by the knitting cam 10 is completed.

JP-A 6-220752 discloses three-position locking type needle selecting apparatus capable of selecting the above-described three positions of A, H and B for needles and locking these positions such that a pushed-down condition of a butt on a selecting jack can be maintained even when the selecting jack is pushed up by a selector to advance to A position and the pressing by a selecting jack presser provided on a carriage is released. JP-A 6-200454 discloses two-position locking type needle selecting apparatus in which B position is shared by the non-operating welting position and the tucking position, and knitting needles are locked in B position in which a needle selection actuator operates at earlier timing. By locking in the welting position, a butt of a needle jack does not engage with a knitting cam while a carriage is traveling. As a result, occurrence of frictional damage and other damage of the butt and the knitting cam is reduced and sliding resistance caused by the shift of the carriage is decreased, thereby reducing the power cost.

In the weft knitting machine in which the knitting needles 6 perform knitting operations using the knitting cam 10 of the carriage 3 as illustrated in FIG. 13, advantages such as prevention of frictional damages and the like and the power cost reduction are expected to be offered by providing the above-described locking mechanism. Furthermore, in addition to the basic knitting operation, another advantage is expected to be offered in a process where a stitch loop is tightened in cooperation with sinker apparatus prior to knitting a new stitch, as disclosed in International Patent Publication WO01/36730. In this step, a stitch holding hook provided at the tip of the sinker is raised from a stitch pressing position to temporarily release the stitch from the stitch holding hook prior to formation of a new stitch. In this condition, the knitting needle is retracted from a needle bed gap to tighten the stitch by a stitch cam on the preceding side which is provided in a descending position where the knitting needle is retracted from the needle bed gap. Subsequently, the tip of the sinker is again lowered, thereby allowing the stitch to be caught by the stitch holding hook. Through this process prior to the stitch formation, the stitch already formed can be securely pressed by the sinker and the succeeding stitch loop can be successfully formed.

In this "preceding retraction" function, the "preceding retraction" is performed by the stitch cam on the preceding side of the knitting system with respect to the traveling carriage 3. At this stage, the butt 12*a* of the selecting jack 12 for the knitting needle 6 for which the non-operative welting position is selected as to the preceding stitch loop is released from the pressing by the B presser 16. As a result, the butt 9*a* of the needle jack 9 rises from the needle groove 5 and is then lowered by the action of the stitch cam on the preceding side. It is not preferable, however, that the knitting needle 6 which did not form a stitch is retracted at the time of the "preceding retraction" as described. A knitting yarn is drawn through the knitting needle every time the knitting system of the carriage 3 passes on the knitting needle 6 in B position where no operation is to be performed, which may give undesirable effects in terms of knitting operation such as wearing and cutting of yarn.

For solving the problem arising from the "preceding retraction", locking the condition where the selecting jack is sunk in the welting position is also effective. However, in the locking mechanisms disclosed in JP-A 6-200454 and JP-A 6-220752, the advancing and retracting action of the selector is essential and thus pressers and other components are required for controlling this action. As a result, a large distance between the knitting systems is needed to provide a plurality of knitting systems on the carriage, which makes the carriage large-sized.

Alternatively, the unnecessary descending action of the knitting needles can be avoided by extending the width of the B presser which pushes down the butt of the selecting jack in the welting position to the position where the stitch loop is tightened or other actions are performed for the step where the stitch loop is tightened or other actions are performed. However, since the selecting jack is returned to B position as the initial position prior to the stitch loop formation at each knitting system, the butt of the selecting jack corresponding to the knitting needle for which the position selected is changed from B position to H position is also pressed by the B presser until the knitting needle advances to H position at the start of knitting operation by the succeeding knitting system when the carriage has a plurality of the knitting systems. As a result, when the knitting needle being pressed in this manner reaches the stitch cam used for the preceding retraction, the preceding retraction cannot be carried out. Accordingly, the length of the carriage in the traveling direction required by the cam increases and thus a distance between the neighboring knitting systems is enlarged, which makes the carriage large in size.

DISCLOSURE OF THE INVENTION

It is an object of the invention to provide a needle selecting apparatus which is included in a weft knitting machine and has an improved mechanism for locking needle selection positions so as to lock needle selection positions without advancing and retracting a selector.

The invention provides a needle selecting apparatus for a weft knitting machine comprising a needle bed having a plurality of needle grooves in rows; a carriage including a selecting mechanism and a cam mechanism, the carriage traveling along the needle bed; and knitting needles each disposed in the needle groove and each having a butt on which the cammechanism of the carriage acts, the needle selecting apparatus comprising:

selectors disposed in each of the needle grooves, for shifting a selecting jack to select any of positions predetermined in correspondence with a plurality of knitting operations including non operation, the selecting jack being capable of being selectively separated from the cam mechanism by pressing the butt from the carriage in cooperation with the selecting mechanism of the carriage with respect to the butt of the knitting needle within each needle groove, the positions being established such that an initial position of the selecting jack corresponds to a non-operative position;

a holding member disposed in a predetermined position in a vicinity of each of the selecting jacks located in the initial position at a distance from the selecting jack; and a locking member provided for each of the selecting jacks, wherein when the selecting jack is pressed from the carriage at the initial position, the locking member is fitted in a space between the selecting jack and the holding member formed on the needle groove so as to maintain the pressed condition of the selecting jack by the locking member inserted between the selecting jack and the holding member, and when the selecting jack is shifted to a position other than the non-operative position by the selector, the locking member is separated from the space so as to release the pressed condition of the selecting jack.

The invention is characterized in that the holding member disposed within each needle groove is a penetrating member which penetrates the needle bed in a direction where the needle grooves are provided in rows and contacts the selecting jack on the side facing the carriage to hold the selecting jack within the needle groove, and the locking member is forced by a spring to be fitted in a space between the penetrating member and the selecting jack on a side facing the carriage.

The invention is characterized in that the selecting jack has a thin-wall portion which has a small thickness on both sides in a plate thickness direction and is disposed in a vicinity of the penetrating member to face the penetrating member in the initial position, the locking member has a forked engaging portion for receiving the thin-wall portion from both sides in the thickness direction, and a fitting portion allowed to enter into the space between the penetrating member and the selecting jack on the side facing the carriage, and the needle selecting apparatus further comprises a spring provided between the thin-wall portion of the selecting jack and the engaging portion of the locking member, for forcing the locking member so as to cause the fitting portion to enter into the space.

The invention is characterized in that the selecting jack has a groove which is substantially U-shaped and has a smaller width at an opening of the groove and is open at a position which is disposed in the vicinity of the penetrating member and faces the penetrating member in the initial position, and the locking member has a forked engaging portion which is inserted into the groove and pressed from both sides of the groove to be forced toward the penetrating member, and a fitting portion allowed to advance into the space between the penetrating member and the selecting jack on the side facing the carriage.

The invention is characterized in that the holding member within each needle groove is a concave portion formed on a side of the selecting jack, and the locking member is a plate spring formed on a side surface of the selecting jack and having a tip which is forced so as to project toward the side and is fitted into the concave portion so as to prevent the selecting jack from being displaced toward the carriage.

The invention is characterized in that the cam mechanism of the carriage has a function for retracting a knitting needle whose butt is not separated prior to execution of the plural knitting operations.

BRIEF DESCRIPTION OF THE DRAWINGS

Other and further objects, features, and advantages of the invention will be more explicit from the following detailed description taken with reference to the drawings wherein.

BEST MODE FOR CARRYING OUT THE INVENTION

Figure 1:
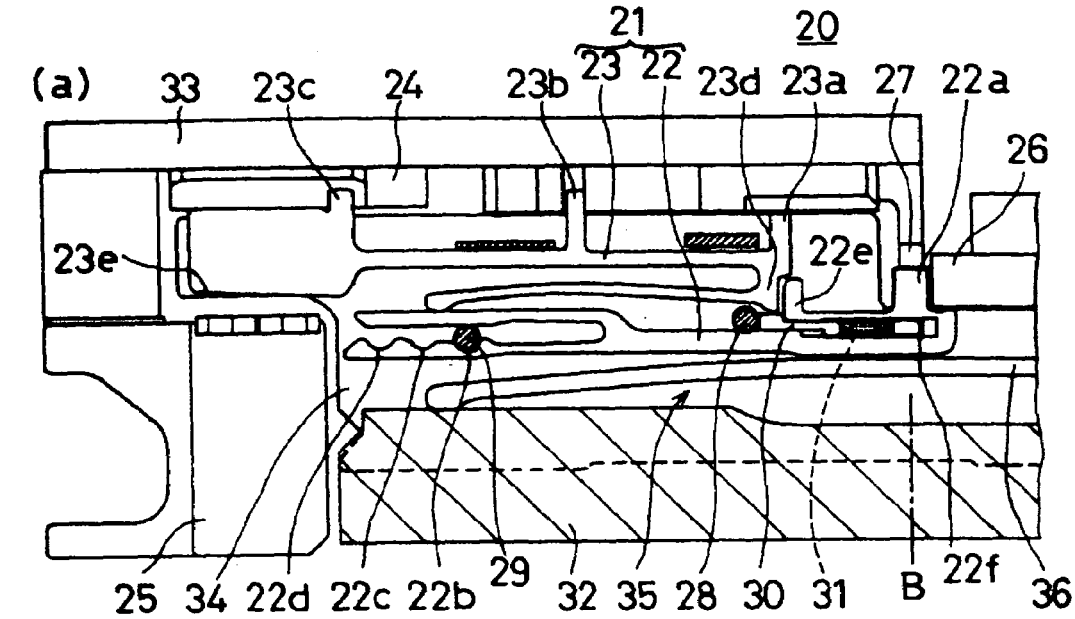
FIGS. 1(*a*) and 1(*b*) are side cross-sectional views showing a needle selecting apparatus 21 included in a weft knitting machine 20 according to a first embodiment of the invention, in a condition where a selecting jack 22 in an initial position as a non-operative welting position is not pressed, and in a locked condition where the selecting jack 22 in the welting position is pressed, respectively.
Figure 1:
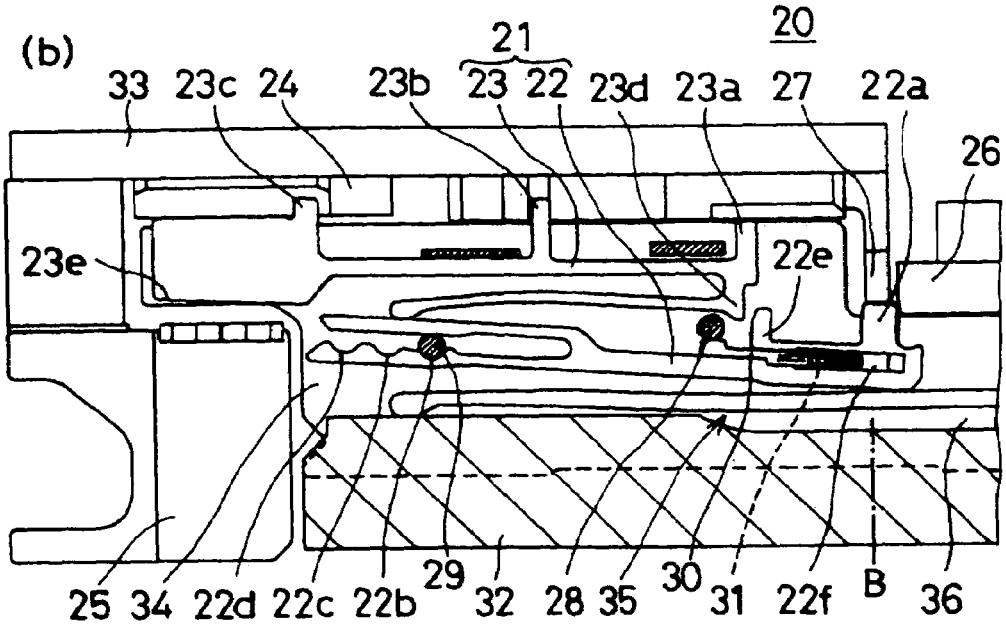

Now referring to the drawings, preferred embodiments of the invention are described below.

Embodiments of the invention are hereinafter described with reference to FIGS. 1 through 12. Mechanisms, components and parts and the like having the same names as those in the part of the invention already described above or in the part corresponding to the related art already described above with reference to FIG. 13 have basically the same functions and structures even if different reference numerals are given, and repetitive description of those is sometimes omitted. The posture of a needle bed and the front-rear direction based on a needle bed gap are determined in the same manner as in FIG. 13. Position A, position H and position B correspond to knitting, tucking and welting (missing) positions, respectively, in each embodiment.

FIGS. 1(*a*) and 1(*b*) each schematically illustrate a cross-sectional structure of a needle selecting apparatus according to a first embodiment of the invention. In this embodiment, a selecting jack 22 of a needle selecting apparatus 21 included in a weft knitting machine 20 can be locked so as to maintain a pressed condition in an initial position where knitting operation is not performed. FIG. 1(*a*) shows a condition where the selecting jack 22 in an initial position as a non-operative welting position is not pressed, while FIG. 1(*b*) shows a condition where the selecting jack 22 is pressed. The needle selecting apparatus 21 includes a selector 23 for shifting the selecting jack 22. The selector 23 has a plurality of butts 23*a*, 23*b* and 23*c*, and the selector cams 24 act on the butts 23*a*, 23*b* and 23*c* to drive the selector 23. A tip 23*d* of the selector 23 contacts the selecting jack 22 to advance the selecting jack 22. An armature 23*e* is formed on a rear end of the selector 23. The armature 23*e* contacts a needle selection actuator 25 when the selector cam 24 presses the butt 23*c*, and is magnetically attracted to the needle selection actuator 25.

A butt 22*a* of the selecting jack 22 which is advanced to a position different from the initial position is returned to B position as the initial position while guided by a guide cam 26. The initial position of the selecting jack 22 is a welting position, where a missing condition in which a knitting yarn is not knitted is selected. In the initial position, the butt 22*a* is pressed by a B presser 27. Wires 28 and 29 are provided to control displacement of the selecting jack 22. The wire 29 is sandwiched by a forked portion in the rear half region of the selecting jack 22. The wire 29 engages with concave portions 22*b*, 22*c* or 22*d* to select the knitting, tucking or welting position.

In this embodiment, a locking member 30 is attached to the selecting jack 22. When the B presser 27 presses the butt 22*a* of the selecting jack 22 in the welting position as the initial position shown in FIG. 1(*b*), the locking member 30 enters into a space between the selecting jack 22 and the wire 28. The locking member 30 is forced by a spring 31. The selecting jack 22 has a contact portion 22*e* with which the tip 23*d* of the selector 23 can contact in both the conditions where the butt 22*a* is not pressed as shown in FIG. 1(*a*) and where the butt 22*a* is pressed as shown in FIG. 1(*b*). The locking member 30 is attached to a thin-wall portion 22*f* extending from the butt 22*a* of the selecting jack 22 to the contact portion 22*e*. The structures associated with the locking member 30 and the thin-wall portion 22*f* will be described later with reference to FIGS. 8 and 9.

When the selecting jack 22 is shifted to the tucking position or the knitting position by the selector 23 which is driven by the selector cams 24, the locking member 30 is drawn from the space between the wire 28 and the selecting jack 22 whereby the locked condition shown in FIG. 1(*b*) is released. The selecting jack 22 lifts until a limit is provided by the wire 28 due to resiliency of the needle jack which is in a pressed condition. In the lifting condition, the butt 22*a* can be pressed by a presser in the tucking position and driven by the guide cam 26. The guide cam 26 retracts the butt 22*a* to return the selecting jack 22 to the initial position. Since the wire 28 contacts the selecting jack 22 to restrict the lifting of the selecting jack 22 when the selecting jack 22 retracts, there is no space between the wire 28 and the selecting jack 22 and thus the locking member 30 cannot enter into the space. As a result, the locking member 30 is pressed toward the front by the wire 28, whereby the spring 31 is compressed and pressed against the thin-wall 22*f* of the selecting jack 22.

The needle selecting apparatus 21 having the above structure is provided on a needle bed 32 of the weft knitting machine 20, and is driven and controlled by the selector cams 24 and the needle selection actuator 25 provided on the carriage 33. The selecting jack 22 and the selector 23 are accommodated within a needle groove 35 formed between needle plates 34 provided in rows on the needle bed 32, and have fixed external shapes which are cut out from metal plate material. The wires 28 and 29 are penetrating members made of piano wire or other material which penetrate the needle plates 34 in the longitudinal direction of the needle bed 32. Metal straps may be employed as the penetrating members. When the selecting jack 22 is sunk within the needle groove 35 in the pressed condition or in the locked condition, the tip thereof pushes down the knitting needle 36 into the needle groove 35, thereby preventing the knitting needle 36 from performing knitting operation.

Figure 2:
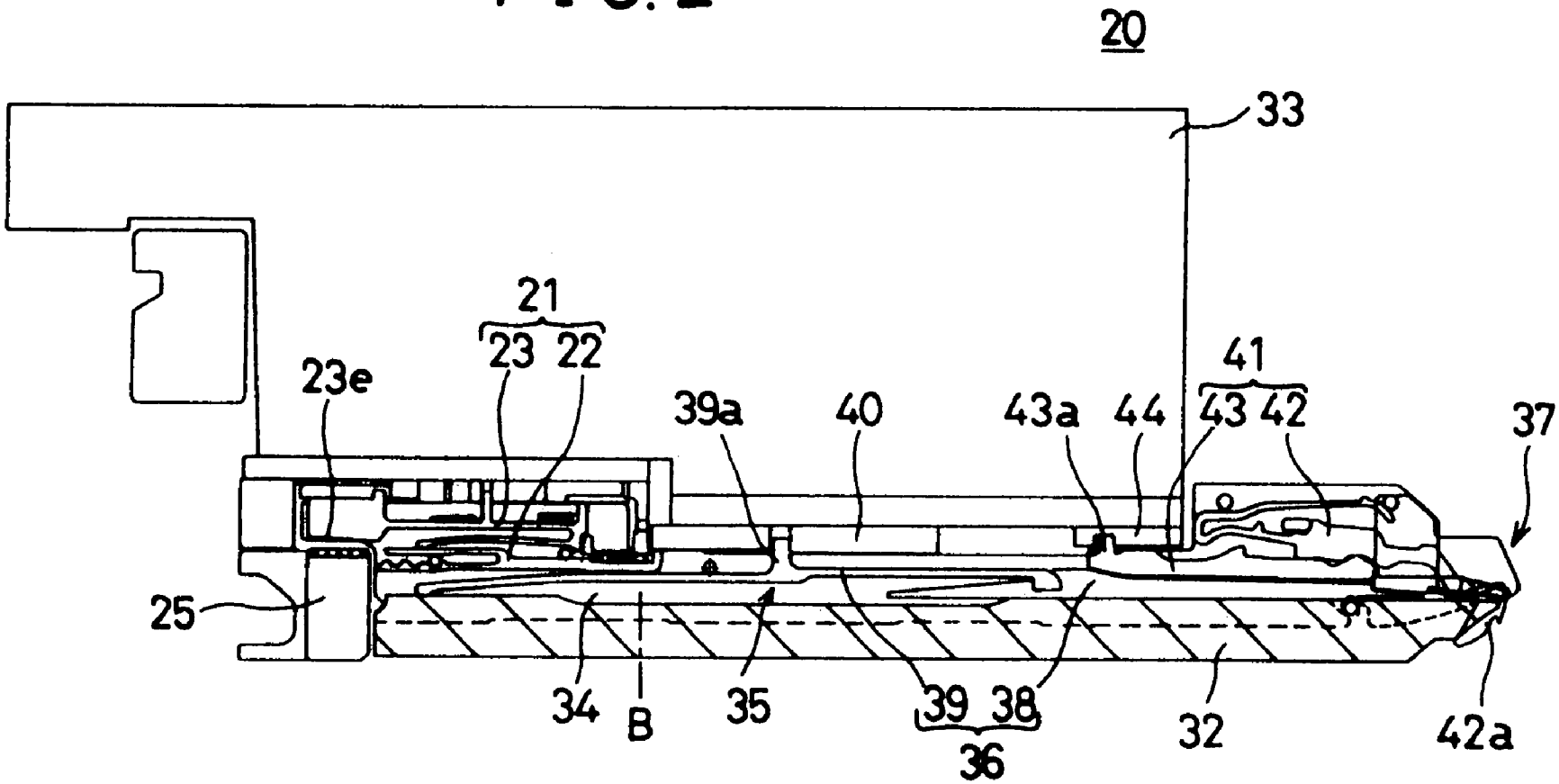
FIG. 2 is a side cross-sectional view illustrating an entire structure of a needle bed 32 including the needle selecting apparatus 21 shown in FIG. 1.

FIG. 2 illustrates an entire structure of the needle bed 32 of the weft knitting machine 20 including the needle selecting apparatus 21 shown in FIG. 1. This figure shows only one of the needle beds 32 opposed to each other with the needle bed gap 37 disposed therebetween in the same manner as in FIG. 13. The knitting needle 36 is a latch needle having a hook and a latch at the front end of a needle main body 38. The knitting needle 36 carries out knitting operation when a knitting cam 40 provided on the carriage 33 acts on a butt 39*a* of a needle jack 39. The needle selecting apparatus 21 selectively separates the butt 39*a* from the knitting cam 40 by pressing the butt 22*a* of the selecting jack 22 using the B presser 27 provided on the carriage 33 or other component to push down the selecting jack 22 and thereby sink the needle jack 39 within the needle groove 35. The knitting needle 36 may be a needle having stitch transferring function or a composite needle.

A sinker apparatus 41 for pushing down a knitting yarn after a stitch is knitted is provided on the needle bed 32 in the vicinity of the tip of the needle bed gap 37. The sinker apparatus 41 has a movable sinker 42 which is forced by a spring to push down a knitting yarn using a knitting yarn holding hook 42*a* disposed at the tip of the movable sinker 42 in an advancing direction toward the needle bed gap 37. When the movable sinker 42 is driven, a sinker control cam 44 provided on the carriage 33 guides a butt 43*a* of a sinker jack 43. The applicant of the invention discloses the structure and action of a weft knitting machine which includes a sinker apparatus having a movable sinker of this type in Japanese Examined Patent Publication JP-B2 5-83657 or others. In this embodiment, it is possible to temporarily raise the knitting yarn holding hook 42*a* of the movable sinker 42 from the needle bed gap 37 so as to retract the knitting needle 36 and tighten a stitch prior to knitting the stitch as disclosed in International Patent Publication WO01/36730.

Figure 3:
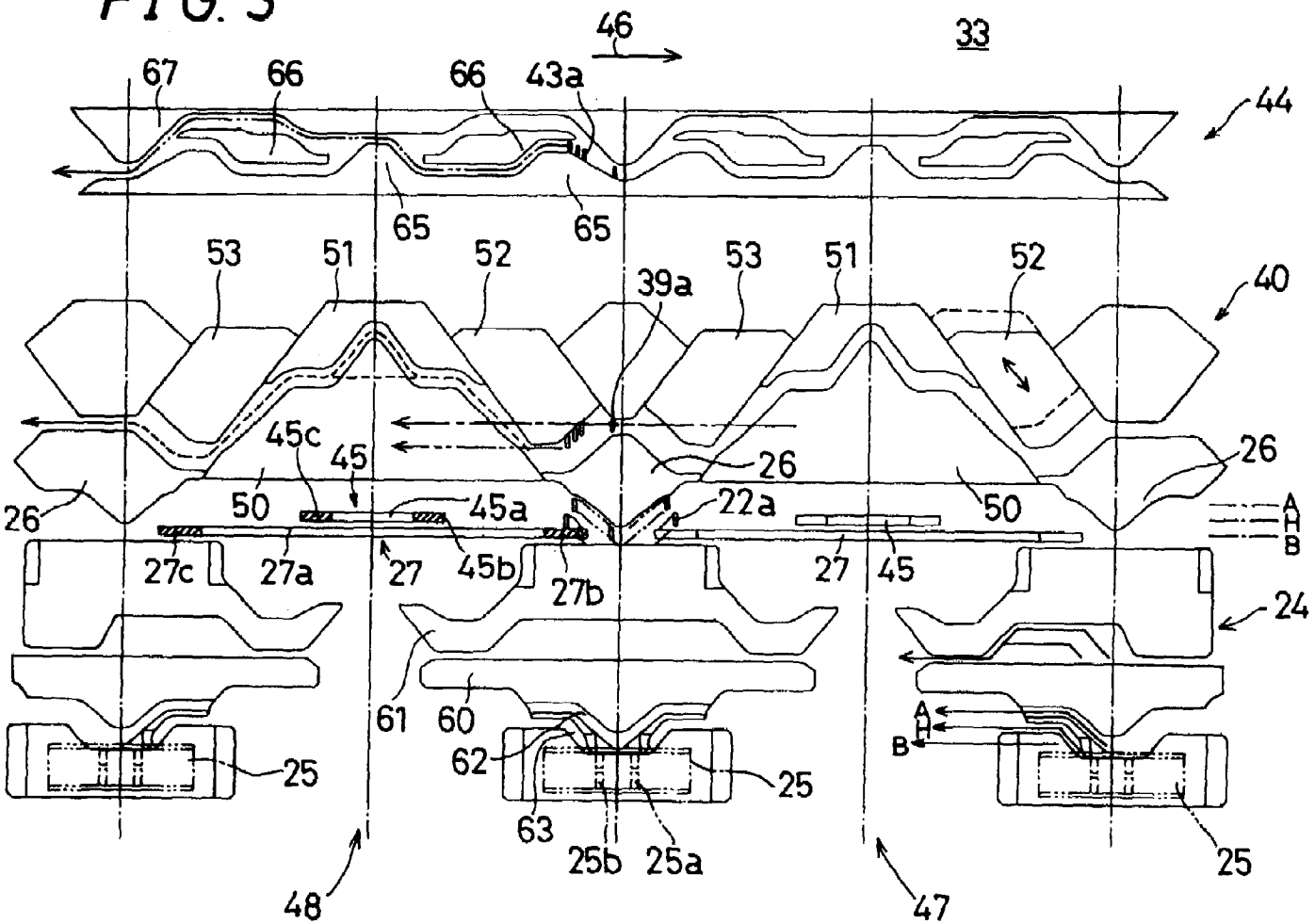
FIG. 3 is a plan view illustrating a cam arrangement on a carriage 33 shown in FIG. 2.

FIG. 3 shows a cam arrangement on a cam carrying surface of the knitting system disposed on the carriage 33 shown in FIG. 2 in such a position as to be opposed to the needle bed 32, placing the needle bed gap 37 side shown in FIG. 2 in the upper part of the figure. As described above, the carriage 33 includes the knitting cam 40, the selector cams 24, the sinker control cam 44, and the B presser 27. An H presser 45 is provided in H position corresponding to the position of the butt 22*a* when the selecting jack 22 is in the tucking position. As illustrated in FIG. 2, the needle selection actuator 25 is actually disposed not on the cam carrying surface of the carriage 33 but in a position opposed to the cam carrying surface and determined such that the needle selection actuator 25 can attract the armature 23*e* of the selector 23 disposed between the needle selection actuator 25 and the carriage 33. However, the needle selection actuator 25 is shown in a corresponding position by a virtual line for the sake of descriptive convenience. The carriage 33 according to this embodiment is equipped with a plurality of knitting systems. The figure shows a preceding system 47 and a succeeding system 48 as viewed in the shift direction of the carriage 33 from the left to the right as indicated by an arrow 46. When a needle having stitch transferring function or a composite needle is employed as the knitting needle 36, a cam for controlling such function is added. Additionally, as long as the initial position can be locked as the non-operative welting position, the cams and the pressers may be changed to alter the number and the type of knitting operation the knitting needle 36 can select in other positions.

The knitting cam 40 includes a needle raising cam 50 for advancing the knitting needle 36 toward the needle bed gap 37, a bridge cam 51 for regulating the advanced condition of the knitting needle 36, stitch cams 52 and 53 for retracting the knitting needle 36 and other components. The stitch cams 52 and 53 can be displaced in the sloping direction of the sloped cam surface of the needle raising cam 50 while being opposed to the sloped cam surface, and determine a stitch density according to the displacement amount. More specifically, the stitch density is determined by a sloped cam surface of the stitch cam 53 opposed to the needle raising cam 50 on the succeeding side with respect to the needle raising cam 50. The actions for retracting the knitting needle 36 and tightening a stitch prior to stitch knitting as described above are performed by the stitch cam 52 on the preceding side, that is, a sloped cam surface of the stitch cam 52 on the preceding side with respect to the sloped cam surface opposed to the needle raising cam 50. The sloped cam surface of the stitch cam 52 is opposed to an upper half cam surface of the guide cam 26.

The succeeding system 48 is herein described, and similar actions are carried out in the preceding system 47 except for the action in the welting position. The butt 39*a* of the needle jack 39 is guided through a cam groove formed between cam surfaces provided on the stitch cams 52 and 53 and the bridge cam 51 and cam surfaces of the needle raising cam 50 and the guide cam 26 along a route indicated by a broken line in the knitting position where the butt 39*a* projects from the needle groove 35 toward the carriage 33. In H position where the butt 22*a* of the selecting jack 22 is in the tucking position, the butt 39*a* of the needle jack 39 is separated from the knitting cam 40 while the butt 22*a* is being pressed by the H presser 45. Thus, the butt 39*a* moves along a route indicated by a dotted line and the needle raising cam 50 acts on the butt 39*a* only halfway.

In the welting position where the butt 22*a* of the selecting jack 22 is pressed by the B presser 27, the butt 39*a* travels along a route indicated by an alternate long and short dash line when the preceding system 47 is locked. When the invention is not applied, the butt 39*a* moves along a route indicated by an alternate long and two short dashes line. On the preceding system 47 side, the butt 39*a* also moves along the route indicated by the alternate ling and short dash line when the preceding knitting operation is in the locked condition. More specifically, in the locked condition, the butt 39*a* of the selecting jack 39 remains sunk within the needle groove 35 and does not engage with the cam groove of the knitting cam 40 as long as the welting position continues to be selected in the next knitting system. Accordingly, in the locked condition, it is possible to prevent the stitch cam 52 on the preceding side from retracting the knitting needle 36 in the welting position until any position other than the welting position is selected.

The lower half of the guide cam 26 on the preceding side functions as a cam surface for the butt 22*a* of the selecting jack 22, and compulsorily guides the butt 22*a* to the initial position when the selecting jack 22 exists in the knitting position or the tucking position other than the welting position as the initial position. The lower end position to which the guide cam 26 guides the butt 22*a* is required to coincide with the position where the B presser 27 presses the butt 22*a*. The B presser 27 and the H presser 45 have flat pressing surfaces 27*a* and 45*a*, respectively, which project from the cam carrying surface toward the needle bed 32 so as to obtain a sufficient amount for pressing the butt 22*a* to sink the butt 39*a* of the needle jack 39 within the needle groove 35. Sloping surfaces 27*b*, 27*c*, 45*b*, and 45*c* which are crosshatched in the figure are provided on the pressing surfaces 27*a* and 45*a*, respectively, on both the preceding and succeeding sides to smoothly guide the top of the butt 22*a* to the pressing surfaces of the B presser 27 and the H presser 45.

Each of the selector cams 24 which act on the butts 23*a*, 23*b* and 23*c* of the selector 23 includes selector guide cams 60 and 61. The selector cams 24 are each positioned in front of the preceding system 47, between the preceding system 47 and the succeeding system 48, and behind the succeeding system 48. That is, the selector cams 24 are provided between the knitting systems and before and after the knitting systems. The preceding side and the succeeding side of the selector cam 24 provided between the knitting systems are symmetrical. The selector cams 24 disposed before and after the knitting systems act on the butts 23*a*, 23*b* and 23*c* in the inner region where the knitting systems are positioned.

A cam groove for A position 62 and a cam groove for H position 63 are formed below the selector guide cam 60. The selector guide cam 61 guides the butt 23*b* of the selecting jack 23 to return the butt 23*b* to the initial position. The armature 23*e* of the selecting jack 23 is magnetically attracted to the needle selection actuator 25, whereby the butt 23*c* is separated from the selector guide cam 60. Coil magnetic poles 25*a* and 25*b* of the needle selection actuator 25 are disposed symmetrical with respect to the center so as to release the magnetic attraction.

When the coil magnetic pole 25*a* which is on the preceding side when the carriage 33 travels in the direction indicated by the arrow 46 is energized, the butt 23*c* engages with the cam groove for A position 62. In this condition, the butt 23*c* is guided along the route indicated by the broken line to advance the selector 23 and shift the selecting jack 22 to the knitting position. When the coil magnetic pole 25*a* on the preceding side is not energized but the coil magnetic pole 25*b* on the succeeding side is energized, the butt 23*c* engages with the cam groove for H position 63. In this condition, the butt 23*c* is guided along the route indicated by the dotted line to advance the selector 23 and shift the selecting jack 22 to the tucking position. When the selecting jack 22 reaches the tucking position, the butt 22*a* is pressed by the H presser 45.

The sinker control cam 44 includes a raising cam 65 for raising the knitting yarn holding hook 42*a* from the needle bed gap 37 at the time of knitting yarn supply and the above-described preceding retraction in knitting operation, a lowering cam 66 for lowering the raised knitting yarn holding hook 42*a* toward the needle bed gap 37, and a lowering cam 67 for lowering the knitting yarn holding hook 42*a* after knitting operation is finished. The butt 43*a* of the sinker jack 43 is guided to a cam groove formed by the raising cam 65, the lowering cam 66 and the lowering cam 67, and is displaced along the route indicated by the alternate long and two short dashes line at the time of traveling in the direction indicated by the arrow 46.

Figure 4:
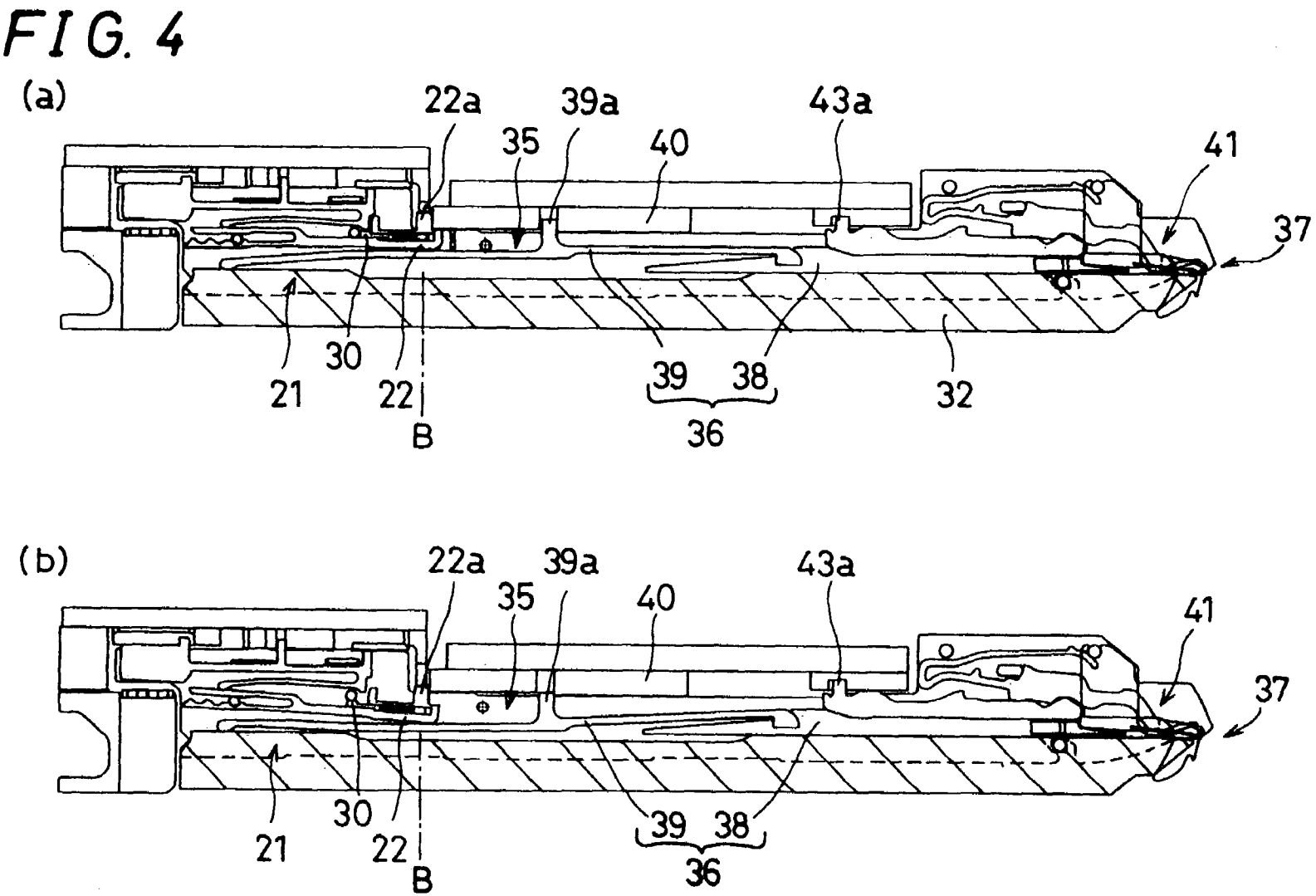
FIGS. 4(*a*) and 4(*b*) are side cross-sectional views each illustrating an entire controlled condition of the needle bed 32 corresponding to FIG. 1.

FIGS. 4(*a*) and 4(*b*) each illustrate the entire needle bed 32, showing the conditions where the selecting jack 22 of the needle selecting apparatus 21 in the initial position is not pressed and pressed in correspondence with FIGS. 1(*a*) and 1(*b*), respectively. In the non-pressed condition shown in FIG. 4(*a*), the butt 39*a* of the needle jack 39 projects out and the knitting cam 40 acts on the butt 39*a*. In the pressed condition shown in FIG. 4(*b*), the butt 39*a* is sunk within the needle groove 35 whereby the knitting cam 40 does not act on the butt 39*a*. Since the locked condition is maintained by means of the locking member 30 according to this embodiment, the condition where the butt 39*a* of the needle jack 39 is sunk within the needle groove 35 continues even after the pressed condition of the butt 22*a* of the selecting jack 22 is released.

Figure 5:
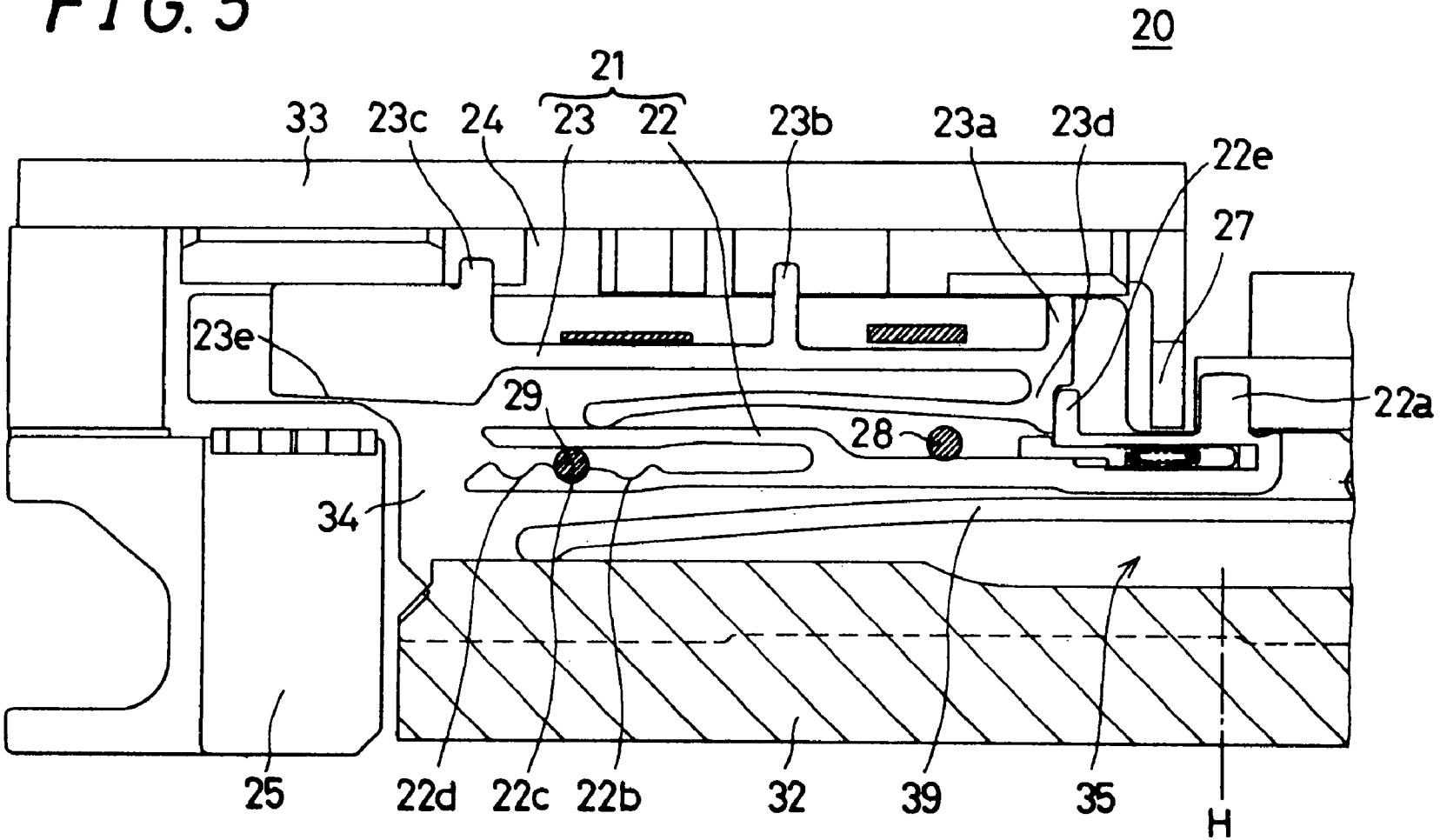
FIG. 5 is a side cross-sectional view illustrating a non-pressed condition where a selector 23 and the selecting jack 22 are set in a tucking position by selector cams 24 in the needle selecting apparatus 21 shown in FIG. 1.

FIG. 5 illustrates the needle selecting apparatus 21 shown in FIG. 1, showing a condition where the selector 23 and the selecting jack 22 are set in the tucking position (H position) by means of the selector cams 24. The needle selection actuator 25 is selectively driven so that the butt 23*c* of the selector 23 engages with the cam groove for H position 63 of the selector guide cam 60. Since the locking member 30 is positioned away from the wire 28, the locking member 30 cannot enter into the space between the wire 28 and the selecting jack 22 even when the butt 22*a* of the selecting jack 22 is pressed from the carriage 33. Thus, a locked condition is not established.

Figure 6:
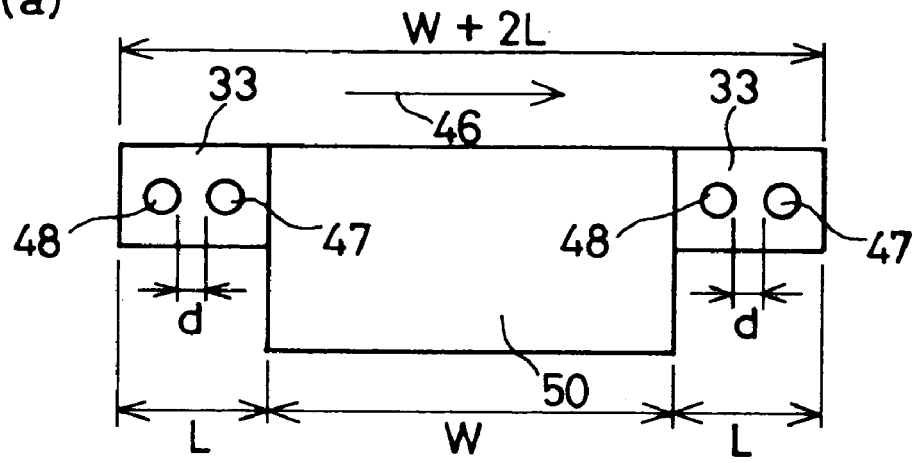
FIGS. 6(*a*) and 6(*b*) are front views each explaining how an enlarged distance between knitting systems affects the weft knitting machine 20 through a simplified illustration.
Figure 6:
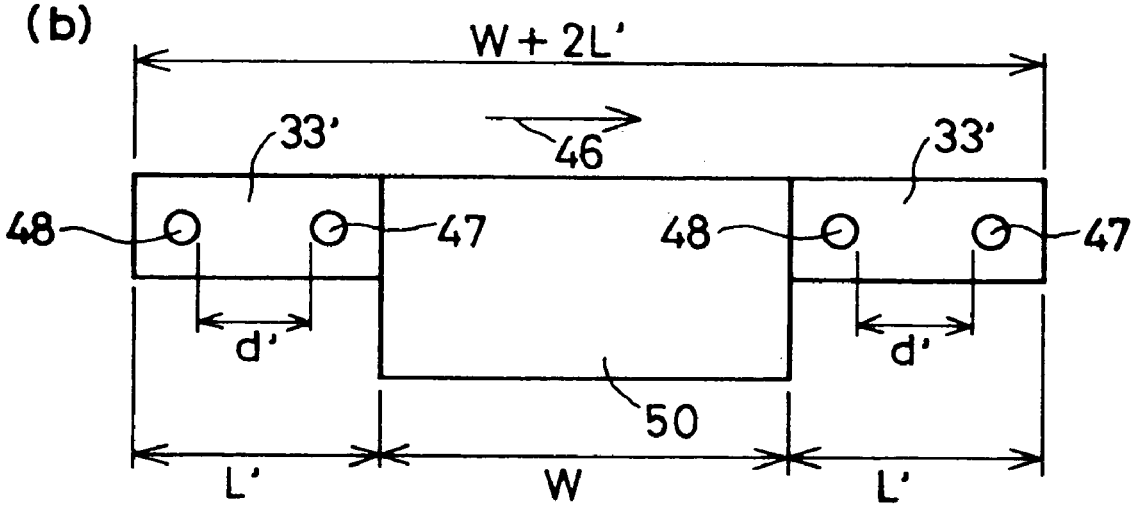

FIGS. 6(*a*) and 6(*b*) are simplified illustrations each explaining how an enlarged distance between the knitting systems affects the weft knitting machine 20. FIG. 6(*a*) shows an example in this embodiment, while FIG. 6(*b*) shows an example having an enlarged distance between the knitting systems without providing a locking function. A carriage 33' shown in FIG. 6(*b*) requires a larger distance d' between the preceding system 47 and the succeeding system 48 than a distance d there between in the carriage 33 shown in FIG. 6(*a*). Thus, a length L' of the carriage 33' is larger than a length L of the carriage 33. When the carriages 33 and 33' knit a knitting area 70 having the same width W, the carriage 33 travels in a range of W+2L in FIG. 6(*a*) and the carriage 33' travels in a range of W+2L' in FIG. 6(*b*). In the carriage 33 according to this embodiment, since the selecting jack 22 is locked in the welting position to sink the butt 39*a* of the knitting needle 36 within the needle groove 35, the carriage 33 can be made compact and the weight and cost and also the power cost can be decreased. Additionally, since unnecessary actions given to the butt 39*a* such as unnecessary preceding retraction are reduced, undesirable effects on the knitting yarn, the butt 39*a* and others can be decreased.

Figure 7:
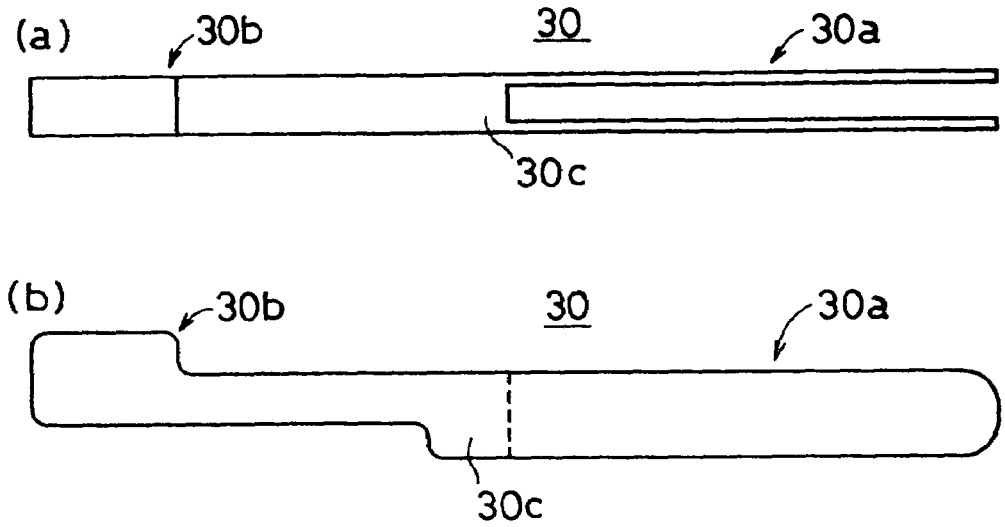
FIGS. 7(*a*) and 7(*b*) are a plan view and a side view, respectively, each illustrating an enlarged shape of a locking member 30 shown in FIG. 1.

FIGS. 7(*a*) and 7(*b*) are enlarged views of the locking member 30 shown in FIG. 1. FIG. 7(*a*) is a plan view as viewed from above in FIG. 1, while FIG. 7(*b*) is a side view as viewed from the front in FIG. 1. The locking member 30 is a plate component made of an elastic material such as a metal plate having a thickness similar to that of the selecting jack 22, and has a forked engaging portion 30*a* and a fitting portion 30*b*. The fitting portion 30*b* can enter into a space between the wire 28 and the selecting jack 22 on the carriage side there of, which space is produced by pressing the selecting jack 22 in the welting position. A holding member 30*c* is formed in the intermediate position between the engaging portion 30*a* and the fitting portion 30*b*.

Figure 8:
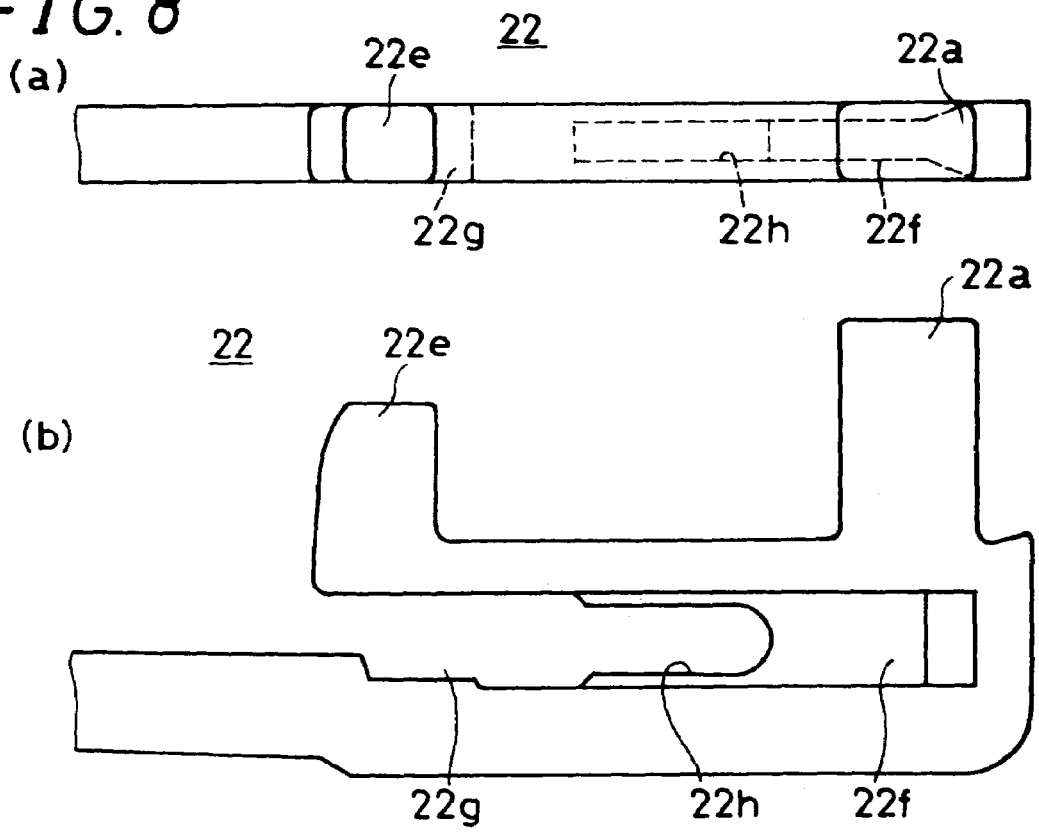
FIGS. 8(*a*) and 8(*b*) are a plan view and a side view, respectively, each partially illustrating enlarged structure and shape of a thin-wall portion 22*f* of the selecting jack 22 to which the locking member 30 is attachable.

FIGS. 8(*a*) and 8(*b*) are enlarged views each partially illustrating the shape and the structure of the thin-wall portion 22*f* of the selecting jack 22 to which the locking member 30 is attachable. FIG. 8(*a*) is a plan view corresponding to FIG. 7(*a*), while FIG. 8(*b*) is a side view corresponding to FIG. 7(*b*) The selecting jack 22 has the thin-wall portion 22*f* which is disposed in the vicinity of the penetrating member such as the wire 28 and faces the penetrating member in the initial position. The thin-wall portion 22*f* has a thickness which decreases on both sides of the selecting jack 22 in the plate thickness direction. The thin-wall portion 22*f* has a notch 22*g* near the wire 28 as to retain the holding member 30*c* shown in FIG. 7. The thin-wall portion 22*f* also has a concave portion 22*h* at the center of the thin-wall portion 22*f* so as to accommodate the spring 31. The thin-wall portion 22*f* and the notch 22*g* are so formed as to switch between the condition where the locking member 30 compresses the spring 31 and is pushed against the front components as shown in FIG. 1(*a*) and the locked condition where the locking member 30 projects toward the rear region by the spring force of the spring 31 as shown in FIG. 1(*b*) when the locking member 30 is attached.

Figure 9:
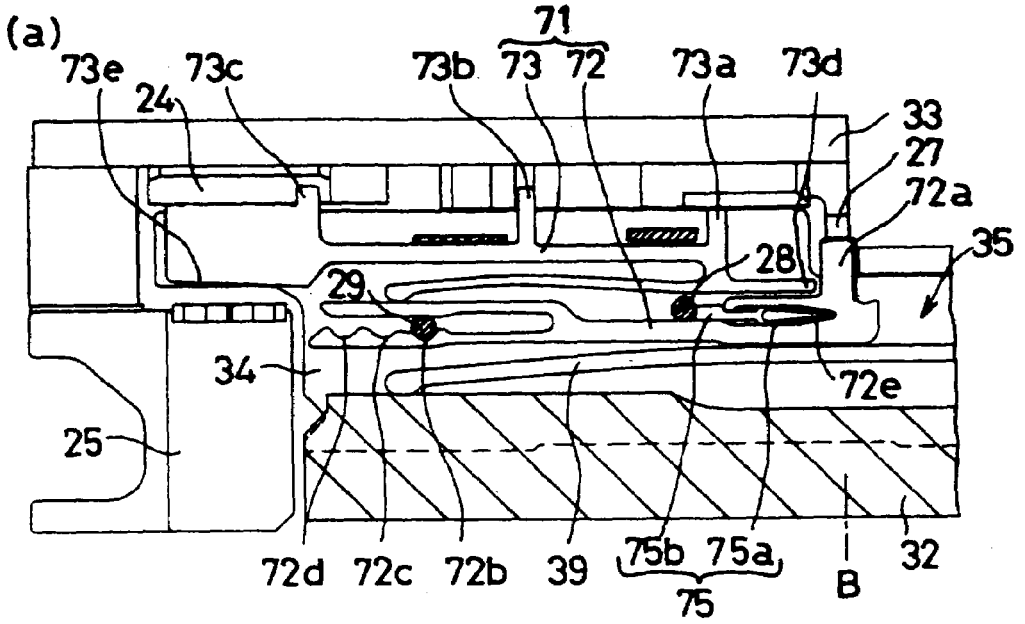
FIGS. 9(*a*) and 9(*b*) are side cross-sectional views showing a needle selecting apparatus 71 according to a second embodiment of the invention, in a condition where a selecting jack 72 in an initial position as a non-operative welting position is not pressed, and in a locked condition where the selecting jack 72 in the welting position is pressed, respectively.
Figure 9:
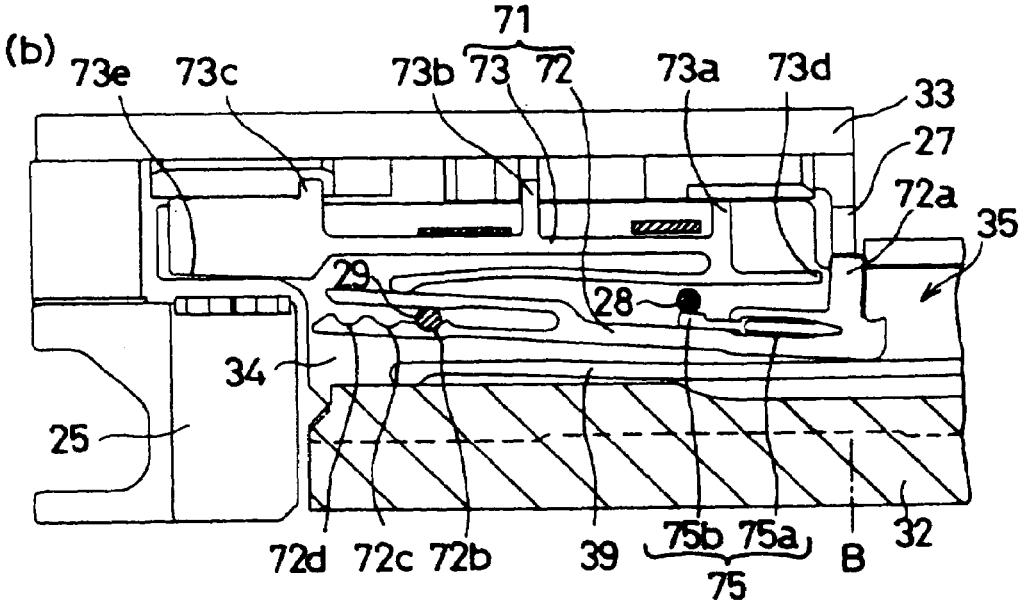

FIGS. 9(*a*) and 9(*b*) are cross sectional views each schematically illustrating a structure of a needle selecting apparatus included in a weft knitting machine according to a second embodiment of the invention. In a needle selecting apparatus 71 according to this embodiment, a selecting jack 72 can be locked to maintain a pressed condition in the initial position where no knitting operation is performed, similarly to the preceding embodiment. FIG. 9(*a*) shows a condition where the selecting jack 72 in the initial position as the welting position is not pressed, while FIG. 9(*b*) shows a condition where the selecting jack 72 is pressed. The needle selecting apparatus 71 has a selector 73 for shifting the selecting jack 72. The selector 73 has a plurality of butts 73*a*, 73*b* and 73*c*. The actions of the selector cams 24 given to the butts 73*a*, 73*b* and 73*c* so as to drive the selector are basically the same as those in the needle selecting apparatus 21 in FIGS. 1(*a*) and 1(*b*). A tip 73*d* of the selector 73 contacts the butt 72*a* of the selecting jack 72 to advance the selecting jack 72. An armature 73*e* disposed near the rear end of the selector 73 contacts the needle selection actuator 25 and is magnetically attracted thereto when the selector cams 24 press the butt 73*c*. Concave portions 72*b*, 72*c* and 72*d* are also provided such that the selecting jack 72 engages with and positions the wire 29 in the same manner as in the needle selecting apparatus 21 shown in FIGS. 1(*a*) and 1(*b*).

The selecting jack 72 according to this embodiment has a groove 72*e* which is disposed in the vicinity of the tip of the selecting jack 72 and faces the wire 28 in the initial position. A locking member 75 is inserted in to the groove 72*e* and is movable forward and backward with in the groove 72*e*. The locking member 75 is a plate component made of an elastic material such as a metal plate. An engaging portion 75*a* as the front half of the locking member 75 is inserted into the groove 72*e*, and a fitting portion 75*b* as the rear half of the locking member 75 projects from an opening of the groove 72*e* toward the wire 28.

Figure 10:
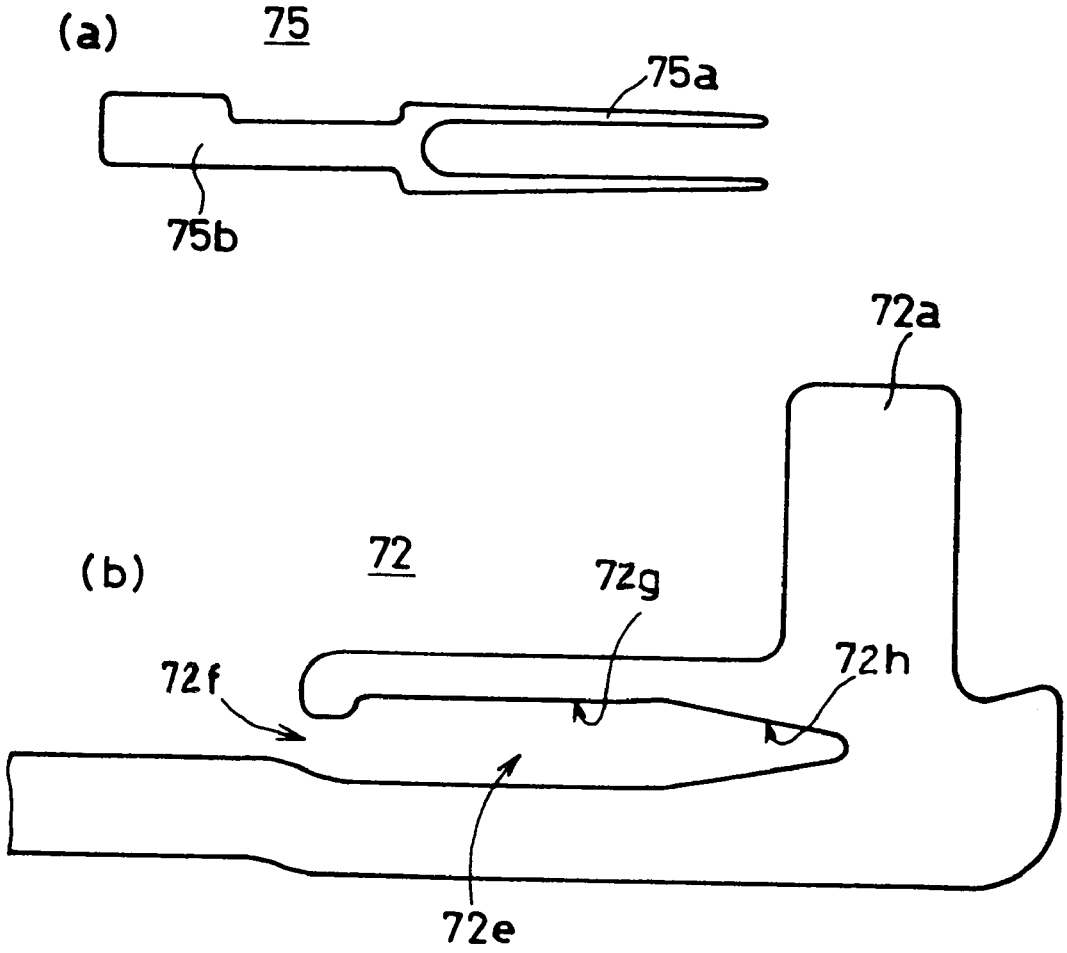
FIGS. 10(*a*) and 10(*b*) are a side view of a locking member 75 shown in FIG. 9, and a partial side view around a groove 72*e* of the selecting jack 72, respectively.

FIG. 10(*a*) is a side view illustrating the shape of the locking member 75, while FIG. 10(*b*) is a side view partially illustrating the shape of the selecting jack 72 around the groove 72*e*. As illustrated in FIG. 10(*a*), the locking member 75 has the engaging portion 75*a* as the front half and the fitting portion 75*b* as the rear half. The engaging portion 75*a* is forked at the tip, and has a smaller width at the base end in the vertical direction. The fitting portion 75*b* is formed next to the base end of the engaging portion 75*a* having the smaller width. As illustrated in FIG. 10(*b*), the groove 72*e* of the selecting jack 72 is substantially U-shaped, and has an opening 72*f* which has a smaller width. The groove 72*e* includes the opening 72*f*, a parallel portion 72*g* which has a constant and larger width than that of the opening 72*f*, and a sloping portion 72*h* which is formed next to the parallel portion 72*g* and has a smaller width.

In the locking member 75 according to this embodiment, the forked tip of the engaging portion 75*a* receives resilient force when the locking member 75 curves along the sloping portion 72*h* of the groove 72*e*, and is forced toward a direction where the locking member projects from the groove 72*e*. More specifically, the shape of the locking member 75 itself allows the fitting portion 75*b* to project out in to the locked condition as shown in FIG. 10(*b*) in cooperation with the sloping portion 72*h* of the groove 72*e*. The selecting jack 72 and the locking member 75 are accommodated within the needle groove 35 formed between the needle plates 34. Since the selecting jack 72 and the locking member 75 are sandwiched between the needle plates 34 from both sides in the plate thickness direction, the selecting jack 72 and the locking member 75 do not come off in the plate thickness direction as long as the difference between the width and the thickness of the needle groove 35 is not too large. Since the width of the engaging portion 75*a* of the locking member 75 is larger than the width of the opening 72*f* of the groove 72*e* of the selecting jack 72, the engaging portion 75*a* is regulated to separate from the groove 72*e* toward the opening 72*f*.

Figure 11:
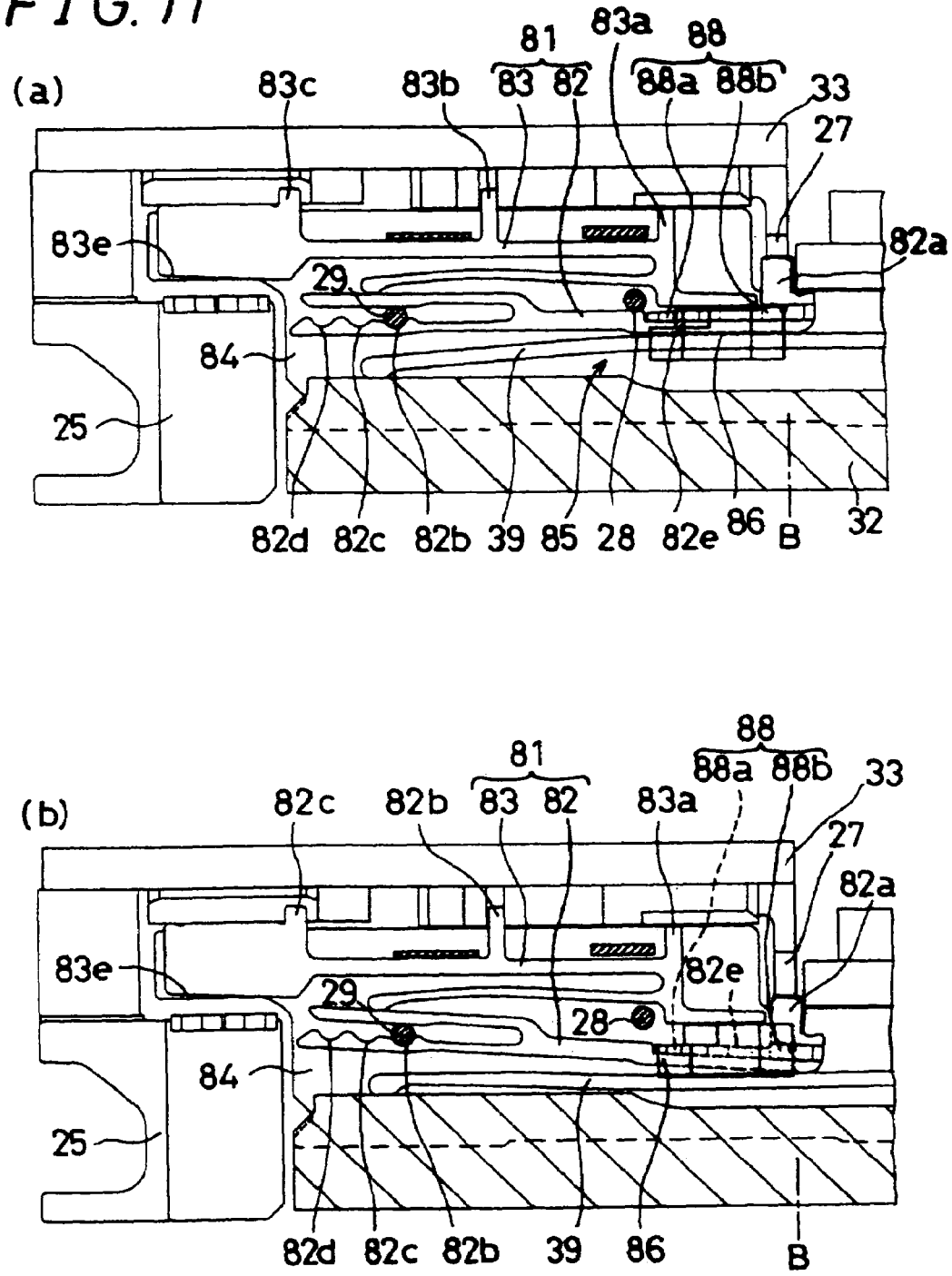
FIGS. 11(*a*) and 11(*b*) are side cross-sectional views showing a needle selecting apparatus 81 according to a third embodiment of the invention, in a condition where a selecting jack 82 in an initial position as a non-operative welting position is not pressed, and in a locked condition where the selecting jack 82 in the welting position is pressed, respectively.

FIGS. 11(*a*) and 11(*b*) are cross-sectional views each schematically illustrating a structure of a needle selecting apparatus included in a weft knitting machine according to a third embodiment of the invention. In a needle selecting apparatus 81 according to this embodiment, a selecting jack 82 can be locked to maintain a pressed condition in the initial position where no knitting operation is performed, similarly to the preceding embodiments. FIG. 11(*a*) shows a condition where the selecting jack 82 in the initial position as the welting position is not pressed, while FIG. 11(*b*) shows a condition where the selecting jack 82 is pressed. The needle selecting apparatus 81 has a selector 83 for shifting the selecting jack 82. The selector 83 has a plurality of butts 83*a*, 83*b* and 83*c*. The actions of the selector cams 24 given to the butts 83*a*, 83*b* and 83*c* so as to drive the selector 83 are basically the same as those in the needle selecting apparatus 21 in FIG. 1. A tip 83*d* of the selector 83 contacts the butt 82*a* of the selecting jack 82 to advance the selecting jack 82, and an armature 83*e* disposed near the rear end of the selector 83 contacts the needle selection actuator 25 and is magnetically attracted there to when the selector cams 24 press the butt 83*c*, in the same manner as in the embodiment shown in FIG. 9. Concave portions 82*b*, 82*c* and 82*d* are also provided such that the selecting jack 82 engages with and positions the wire 29 in the same manner as in the needle selecting apparatus 21 shown in FIGS. 1(*a*) and 1(*b*).

A needle plate 84 according to this embodiment has a holding concave portion 86 in a position corresponding to a wall surface of a needle groove 85 between the wire 28 and the butt 82*a* when the selecting jack 82 is in the initial position. An attaching concave portion 82*e* to which a plate spring 88 as a locking member is attached is formed on the selecting jack 82.

Figure 12:
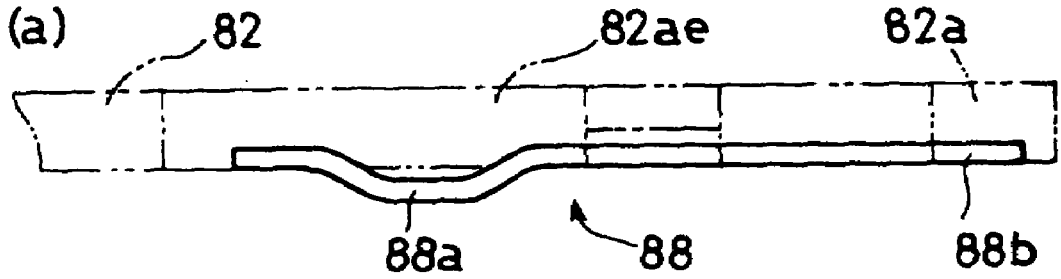
FIGS. 12(*a*) and 12(*b*) are a plan view and a side view, respectively, illustrating a shape of a plate spring 88 shown in FIG. 1.
Figure 12:
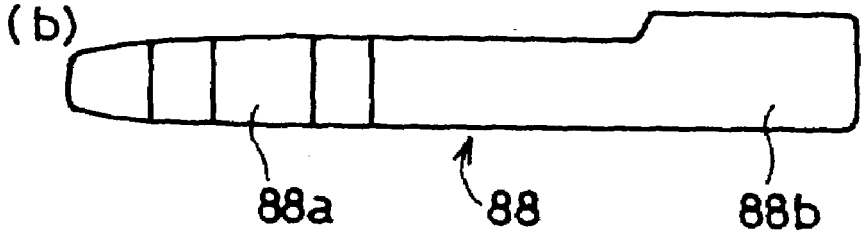
Figure 13:
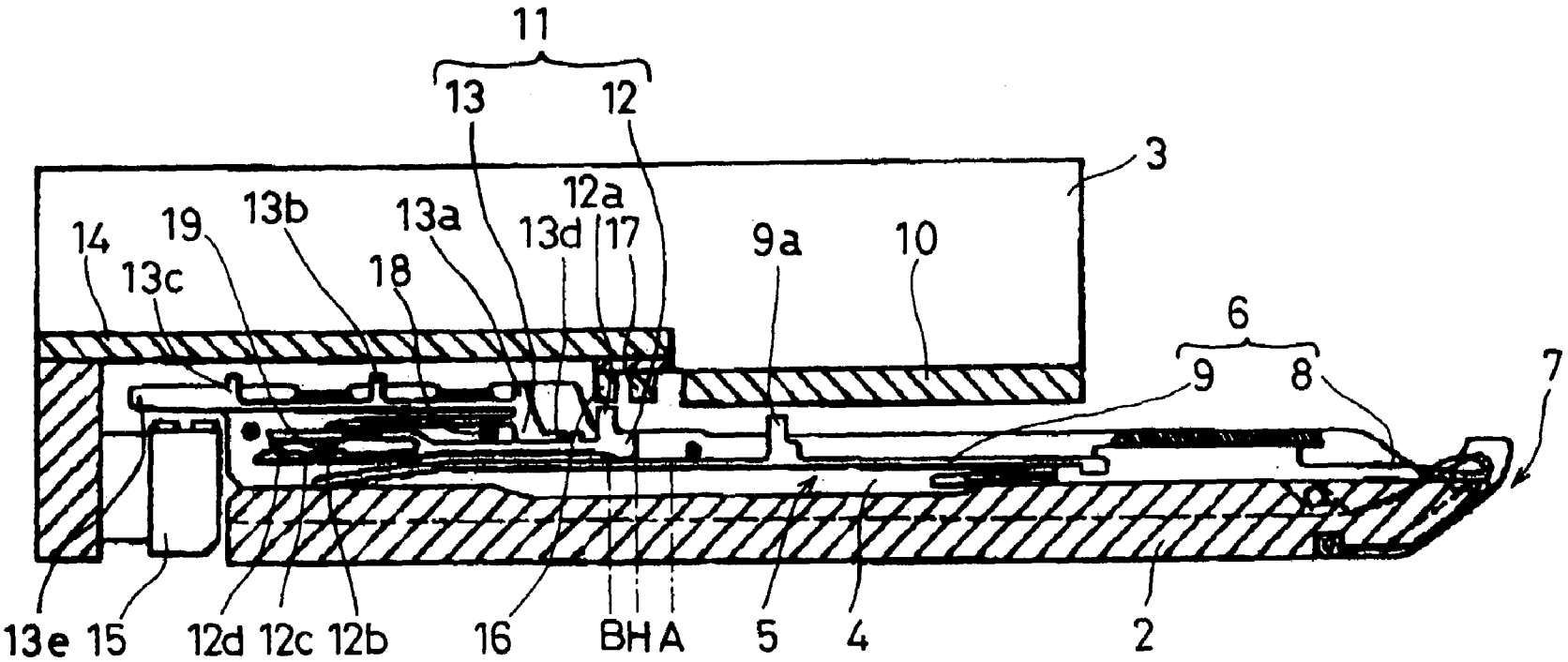
FIG. 13 is a side cross-sectional view illustrating a needle selecting apparatus 21 provided on a needle bed of a conventional weft knitting machine.

FIGS. 12(*a*) and 12(*b*) each illustrate a shape of the plate spring 88. FIG. 12(*a*) is a plan view and FIG. 12(*b*) is a side view of the plate spring 88. In the plan view of FIG. 12(*a*), the selecting jack 82 is also shown by a virtual line. The plate spring 88 has a folded tip 88*a* and a flat base end 88*b*. The base end 88*b* is attached to the attaching concave portion 82*e* of the selecting jack 82. The tip 88*a* projects from the attaching concave portion 82*e* toward the side of the selecting jack 82 when external force is not applied. The tip 88*a* is pressed against the side of the needle plate 84 as a wall surface except for the portion where the holding concave portion 86 is formed within the needle groove 85, whereby the tip 88*a* is pressed into the attaching concave portion 82*e*.

As illustrated in FIG. 11(*b*), when the butt 82*a* of the needle jack 82 is pressed from the carriage 33, the tip 88*a* of the plate spring 88 engages with a step formed by the side of the needle plate 84 and the holding concave portion 86 so as to maintain the locked condition. The holding concave portion 86 has a sufficient space for accommodating the tip 88*a* of the plate spring 88 to which no load is applied. However, in positions other than the locked position, the selecting jack 82 needs to freely move in the needle groove 85 without receiving more than necessary sliding load. When the selector 83 is shifted to the tucking position or the knitting position, the tip 88*a* of the plate spring 88 is separated from the step of the holding concave portion 86 to release the locked condition. When the tip 88*a* is pressed against the side of the needle plate 84 and pushed into the attaching concave portion 82*e* of the selecting jack 82, the selecting jack 82 can freely move within the needle groove 85. During unlocked condition, the locked condition is not established only by returning the selecting jack 82 to the welting position as the initial position as shown in FIG. 12(*a*).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention as described above, when an initial position of a selecting jack which is shifted by a selector within a needle groove is established in a position where no knitting operation is performed and the selecting jack is pressed from a carriage, a locking member is fitted to a space between the selecting jack and a holding member which is formed in a predetermined position in the vicinity of the selecting jack in the initial position with at a distance from the selecting jack so as to maintain the pressed condition of the selecting jack by means of the locking member inserted between the holding member and the selecting jack. Accordingly, the needle selection position can be locked without advancing and retracting the selecting jack. Since a butt of a knitting needle is separated from a cam mechanism of the carriage while the pressed condition of the selecting jack is maintained, knitting operation is not performed.

When the selecting jack is shifted to a position other than the non-operative position by a selector, the locking member separates from the space to release the pressed condition of the selecting jack. Thus, the action of the cam mechanism given to the butt of the knitting needle can be controlled by pressing the selecting jack via a presser provided on the carriage in accordance with types of knitting operation. Since the initial position of the selecting jack corresponds to the non-operative position for the knitting needle, the locking member does not require the selector and the selecting jack to be shifted as long as the cam mechanism of the carriage is continuously in the non-operative condition while passing through the knitting needle. As a result, abrasion and damage caused by the shifting and the power cost can be reduced.

According to the invention, the holding member is formed by a penetrating member which contacts the selecting jack on the side facing the carriage in each needle groove to retain the selecting jack within the needle groove, and the locking member which is forced by a spring is fitted to a space between the selecting jack and the penetrating member by pressing the selecting jack from the carriage. Accordingly, the pressed condition of the selecting jack from the carriage can be transferred to the pressed condition of the selecting jack from the holding member via the locking member so as to maintain the pressed condition of the selecting jack. When the selecting jack is shifted from the non-operative initial position to other positions corresponding to other types of knitting operation, the locking member separates from the space and the pressed condition is released. Thus, knitting needle can be controlled by selecting the pressed condition of the selecting jack in accordance with the types of knitting operation.

According to the invention, the selecting jack has a thin-wall portion which has a smaller thickness on both sides in the plate thickness direction and is disposed in the vicinity of the penetrating member and faces the penetrating member in the initial position. A forked engaging portion of the locking member receives the thin-wall portion from both sides in the thickness direction and a fitting portion of the locking member is allowed to enter into the space between the penetrating member and the selecting jack on the side facing the carriage. Thus, the locking member can be disposed within the small space between the selecting jack and the penetrating member in the needle groove. Since a spring for forcing the locking member so as to cause the fitting portion to enter into the space is provided between the thin-wall portion of the selecting jack and the engaging portion of the locking member, the fitting portion of the locking member can be caused to enter into the space to maintain a pressed condition when the selecting jack in the initial position is pressed from the carriage.

According to the invention, the selecting jack has a substantially U-shaped cut portion which is open at a position which is in the vicinity of the penetrating member and faces the penetrating member in the initial position. The cut portion of the selecting jack has a smaller width at the opening. The locking member has a forked engaging portion which is inserted into the cut portion and pressed from both sides of the cut portion to be forced toward the penetrating member, and a fitting portion which is allowed to enter into the space between the penetrating member and the selecting jack on the side facing the carriage. Thus, the fitting portion of the locking member can be caused to enter into the space to maintain the pressed condition when the selecting jack in the initial position is pressed from the carriage.

According to the invention, a concave portion as a holding member is formed on the side of the selecting jack within each needle groove. A locking member provided on the side surface of the selecting jack is a plate spring having a tip which projects to the side by force and is fitted to the concave portion so as to prevent the selecting jack from being displaced toward the carriage. Thus, the pressed condition can be maintained. The pressed condition is released when the selecting jack is shifted to a position other than the initial position. Accordingly, the knitting needle can be controlled by selecting the pressed condition of the selecting jack in accordance with the types of knitting operation.

According to the invention, the cam mechanism of the carriage has a function for retracting a knitting needle whose butt is not separated from the cam mechanism before the cam mechanism acts on the butt of the knitting needle to selectively perform a plurality of knitting operations. Thus, preceding retraction for tightening a stitch or other actions can be carried out in cooperation with a sinker apparatus. Since the pressed condition of the selecting jack is maintained by means of the locking member for the knitting needle in the non-operative position, the butt of the knitting needle is kept separated from the can mechanism until the pressed condition is released so as to prevent preceding retraction or other actions from being executed. It is also possible to avoid undesirable effects on a knitting yarn during knitting operation such as wearing and cutting of yarn caused by drawing a knitting yarn through the knitting needle every time the cam mechanism of the carriage passes through the knitting needle in the position where no operation is to be performed.

The invention claimed is:

1. A needle selecting apparatus for a weft knitting machine having a needle bed with a plurality of needle grooves in rows; a carriage including a selecting mechanism and a cam mechanism, the carriage traveling along the needle bed; and knitting needles each disposed in the needle groove and each having a butt on which the cam mechanism of the carriage acts, the needle selecting apparatus comprising:

selecting jacks each disposed in the needle groove, the selecting jack being selectively pressable away from the carriage by the selecting mechanism to separate the butt of the knitting needle from the cam mechanism;

selectors each disposed in the needle groove, for shifting the selecting jack to select any of positions predetermined in correspondence with a plurality of knitting operations including non operation, the positions being established such that an initial position of the selecting jack corresponds to a non-operative position;

a holding member disposed in a predetermined position in a vicinity of each of the selecting jacks located in the initial position at a distance from the selecting jack; and a locking member provided for each of the selecting jacks, wherein when the selecting jack is pressed away from the carriage at the initial position, the locking member is fitted in a space between the selecting jack and the holding member formed on the needle groove so as to maintain the pressed condition of the selecting jack by the locking member inserted between the selecting jack and the holding member, and when the selecting jack is shifted to a position other than the non-operative position by the selector, the locking member is removed from the space so as to release the pressed condition of the selecting jack.

2. The needle selecting apparatus of claim 1, wherein the holding member disposed within each needle groove is a penetrating member which penetrates the needle bed in a direction that extends through the needle grooves and contacts a side of the selecting jack that faces the carriage to hold the selecting jack within the needle groove, and the locking member is forced by a spring to be fitted in a space between the penetrating member and the side of the selecting jack that faces the carriage.

3. The needle selecting apparatus of claim 2, wherein the selecting jack has a thin-wall portion disposed in a vicinity of the penetrating member to face the penetrating member in the initial position, the locking member has a forked engaging portion for receiving the thin-wall portion from both sides in the thickness direction, and a fitting portion allowed to enter into the space between the penetrating member and the selecting jack on the side facing the carriage, and the needle selecting apparatus further comprises a spring provided between the thin-wall portion of the selecting jack and the engaging portion of the locking member, for forcing the locking member so as to cause the fitting portion to enter into the space.

4. The needle selecting apparatus of claim 2, wherein the selecting jack has a groove which is substantially U-shaped and is open at a position which is disposed in the vicinity of the penetrating member and faces the penetrating member in the initial position, the groove including an opening, a parallel portion which has a constant and larger width than that of the opening, and a sloping portion which is formed next to the parallel portion and tapered so that its width is reduced, and the locking member has a forked engaging portion which is inserted into the groove and pressed from both sides of the groove to be forced toward the penetrating member, and a fitting portion allowed to advance into the space between the penetrating member and the selecting jack on the side facing the carriage.

5. The needle selecting apparatus of claim 1, wherein the holding member within each needle groove is a concave portion formed on a side of the selecting jack, and the locking member is a plate spring formed on a side surface of the selecting jack and having a tip which is forced so as to project toward the side and is fitted into the concave portion so as to prevent the selecting jack from being displaced toward the carriage.

6. The needle selecting apparatus of any one of claims 1 to 5, wherein the cam mechanism of the carriage has a function for retracting a knitting needle whose butt is not separated prior to execution of the plural knitting operations.

* * * * *